US007282676B1

(12) United States Patent
Bouchier et al.

(10) Patent No.: US 7,282,676 B1
(45) Date of Patent: Oct. 16, 2007

(54) INTEGRATING PRECONCENTRATOR HEAT CONTROLLER

(75) Inventors: Francis A. Bouchier, Albuquerque, NM (US); Lester H. Arakaki, Edgewood, NM (US); Eric S. Varley, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 11/341,764

(22) Filed: Jan. 27, 2006

(51) Int. Cl.
*H05B 1/02* (2006.01)

(52) U.S. Cl. ..... 219/497; 219/492; 219/501; 374/101

(58) Field of Classification Search ..... 219/481, 219/499, 497, 492, 501, 505, 494; 374/101
See application file for complete search history.

(56) References Cited

U.S. PATENT DOCUMENTS

| | | | | |
|---|---|---|---|---|
| 4,633,083 | A | 12/1986 | Knorr et al. | |
| H406 | H | 1/1988 | Wohltjen | |
| 4,987,767 | A | 1/1991 | Corrigan et al. | |
| 5,014,541 | A | 5/1991 | Sides et al. | |
| 5,368,391 | A | 11/1994 | Crowe et al. | |
| 5,571,976 | A | 11/1996 | Drolet | |
| 5,854,431 | A | 12/1998 | Linker et al. | |
| 5,915,268 | A | 6/1999 | Linker et al. | |
| 6,085,601 | A | 7/2000 | Linker et al. | |
| 6,334,365 | B1 | 1/2002 | Linker et al. | |
| 6,345,545 | B1 | 2/2002 | Linker et al. | |
| 6,414,475 | B1 * | 7/2002 | Dames et al. | 324/127 |
| 6,523,393 | B1 | 2/2003 | Linker et al. | |
| 6,572,825 | B1 | 6/2003 | Linker et al. | |
| 6,604,406 | B1 | 8/2003 | Linker et al. | |
| 6,666,907 | B1 | 12/2003 | Manginell et al. | |
| 6,787,338 | B2 | 9/2004 | Wittwer et al. | |
| 6,792,794 | B2 | 9/2004 | Bonne et al. | |
| 6,828,795 | B2 | 12/2004 | Krasnobaev et al. | |
| 6,848,325 | B2 | 2/2005 | Parmeter et al. | |
| 6,861,646 | B2 | 3/2005 | Motchkine et al. | |
| 6,870,155 | B2 | 3/2005 | Krasnobaev et al. | |
| 6,888,128 | B2 | 5/2005 | Krasnobaev et al. | |
| 6,978,657 | B1 * | 12/2005 | Baumann et al. | 73/28.04 |
| 2003/0155506 | A1 | 8/2003 | Motchkine et al. | |

(Continued)

OTHER PUBLICATIONS

Franco Basile, A Gas Sample Pre-concentration Device Based on Solid Phase Microextraction (SMPE) and Temperature Programmed Desorption (TPD), vol. 31, No. 2, pp. 155-164, 2003.

*Primary Examiner*—Mark Paschall
(74) *Attorney, Agent, or Firm*—Robert D. Watson

(57) ABSTRACT

A method and apparatus for controlling the electric resistance heating of a metallic chemical preconcentrator screen, for example, used in portable trace explosives detectors. The length of the heating time-period is automatically adjusted to compensate for any changes in the voltage driving the heating current across the screen, for example, due to gradual discharge or aging of a battery. The total deposited energy in the screen is proportional to the integral over time of the square of the voltage drop across the screen. Since the net temperature rise, $\Delta T_s$, of the screen, from beginning to end of the heating pulse, is proportional to the total amount of heat energy deposited in the screen during the heating pulse, then this integral can be calculated in real-time and used to terminate the heating current when a pre-set target value has been reached; thereby providing a consistent and reliable screen temperature rise, $\Delta T_s$, from pulse-to-pulse.

22 Claims, 4 Drawing Sheets

U.S. PATENT DOCUMENTS

2004/0248319 A1 12/2004 Belyakov et al.
2005/0007119 A1 1/2005 Belyakov et al.
2006/0202666 A1* 9/2006 Laig-Hoerstebrock et al. ... 320/150

* cited by examiner

DPDT rely

INTEGRATING PRECONCENTRATOR HEAT CONTROLLER

FEDERALLY SPONSORED RESEARCH

The United States Government has rights in this invention pursuant to Department of Energy Contract No. DE-AC04-94AL85000 with Sandia Corporation.

CROSS-REFERENCE TO RELATED APPLICATIONS

This application is related to co-pending application "*Analyte Separation Utilizing Temperature Programmed Desorption Of A Chemical Preconcentrator*", Linker et al., filed Nov. 22, 2005, Ser. No. 11/286,015 and commonly assigned to Sandia Corporation, which is incorporated herein by reference.

BACKGROUND OF THE INVENTION

The present invention relates generally to chemical detection systems for detecting trace amounts of chemicals, e.g., explosives or narcotics, on clothes, baggage, vehicles, shipping containers, etc. Detectors used in trace explosives detection systems include ion mobility spectrometers (IMS), mass spectrometers (MS), surface acoustic wave sensors (SAW), electron capture devices (ECD), differential mobility spectrometers (DMS), and chemiluminescence detectors (CLD).

In general, IMS detectors (and others with similar operating principles) excel at detecting very small amounts of explosives; including low vapor pressure explosives such as TNT, RDX, PETN, and HMX. Recently, IMS detectors have been successfully miniaturized into a lightweight, battery-powered, hand-portable unit (such as disclosed U.S. Pat. No. 6,978,657, which is incorporated herein by reference).

Two different methods are commonly used to collect samples. Particles of contraband (e.g., explosives, narcotics) are typically collected by swiping a contaminated surface with a small piece of cotton cloth or flexible metallic screen. Vapors (and particles) of contraband can be collected and pre-concentrated by pulling (i.e., vacuuming) contaminated air through a porous metallic screen (such as a stainless steel screen, felt, or screen). Low vapor pressure explosive molecules are "sticky", meaning that they easily adsorb onto the metallic screen. However, high vapor pressure explosives pass through the preconcentrator screen without sticking. Short, concentrated puffs of air can be directed to a surface to dislodge contaminants stuck in clothing, etc., which are then sucked into the preconcentrator module.

Next, the contaminated screen can be removed from the preconcentrator module and placed in a thermal desorption chamber located close to (or, as part of) the detector. In the desorption chamber, the metallic screen is heated to about 180 C to 220 C to vaporize and desorb the contaminants. Depending on how fast the screen is heated up, the contaminants may be released slowly or quickly. Typically, the screen is rapidly heated in a single pulse from room temperature to about 200-210 C in a very short time period (e.g., 0.2-0.4 seconds). With this type of heating pulse (i.e., flash heating), almost all of the collected particles and adsorbed vapors are rapidly vaporized and released at essentially the same time; thereby producing a single, concentrated pulse (i.e., packet, bunch, or group) of analyte gas. Then, a carrier gas (e.g., clean, dry air or nitrogen), flowing through (or across) the screen, carries the desorbed contaminants to the detector, such as a miniature ion mobility spectrometer (IMS) or miniature mass spectrometer (MS). This mode of desorption (flash) generates a much higher concentration of analyte gas, as compared to continuous air sampling. Hence, by flash-desorbing a preconcentrator screen, the signal-to-noise (S/N) ratio of the detector can be increased by a factor of 1000 times or more; as compared to systems that don't use a preconcentrator screen.

The preconcentrator screen (also called a preconcentrator mesh or substrate) is typically heated by flowing a high-amperage (e.g., 50-100 amps) electric current across a stainless-steel screen from one edge of the screen to an opposite edge of the screen; thereby generating internal heat energy by Joule-type electric resistance heating ($P_{heat}=I^2R$). For example, a 12-volt gel-cell type battery can provide about 60 amps of current through a screen having an in-plane electrical resistance, $R_s$, of about 0.2 ohms for a short pulse (e.g., 0.3-0.5 seconds); which generates sufficient heat energy to raise the screen's temperature from room temperature to about 200 C The low impedance of the screen (e.g., 0.2 ohms) effectively short-circuits the battery, causing a high current to flow through the screen. We have found that only certain types of batteries are suitable to provide such a high current draw (e.g., a lead-acid car battery).

In battery-powered, hand-portable detector systems, the battery's voltage gradually decreases (i.e., discharges) over time due to regular use, aging, etc. Hence, assuming a fixed heating time period and a fixed screen electrical resistance, the peak screen temperature also decreases as the battery's voltage decreases. Variances in peak screen temperatures, $T_{max}$, can occur due to variations in the geometry, resistance, contact oxidation, etc. from one screen to the next; or due to variations in properties from one battery to the next.

Since the rates of thermal desorption for the adsorbed contraband chemicals depend strongly (i.e., exponentially) on temperature, then small variations in the peak screen temperature can cause unwanted, large variations in the amount of contaminants desorbed from the screen. What is needed, then, is a heating control system and a control methodology that can provide accurate, repeatable and consistent peak screen temperatures, despite these variations and uncertainties. In particular, a needs exists for compensating for the gradual decline of the battery voltage; as well as for compensating for screen-to-screen variations and battery-to-battery variations. Against this background, the present invention was developed.

SUMMARY OF THE INVENTION

The present invention relates to a method and apparatus for controlling the electric resistance heating of a metallic chemical preconcentrator screen, for example, used in portable trace explosives detectors. The length of the heating time-period is automatically adjusted to compensate for any changes in the voltage driving the heating current across the screen, for example, due to gradual discharge or aging of a battery. The total deposited energy in the screen is proportional to the integral over time of the square of the voltage drop across the screen. Since the net temperature rise, $\Delta T_s$, of the screen, from beginning to end of the heating pulse, is proportional to the total amount of heat energy deposited in the screen during the heating pulse, then this integral can be calculated in real-time and used to terminate the heating current when a pre-set target value has been reached; thereby providing a consistent and reliable screen temperature rise, $\Delta T_s$, from pulse-to-pulse.

BRIEF DESCRIPTION OF THE DRAWINGS

The accompanying drawings, which are incorporated in and form part of the specification, illustrate various examples of the present invention and, together with the detailed description, serve to explain the principles of the invention.

DETAILED DESCRIPTION OF THE INVENTION

Figure 1:
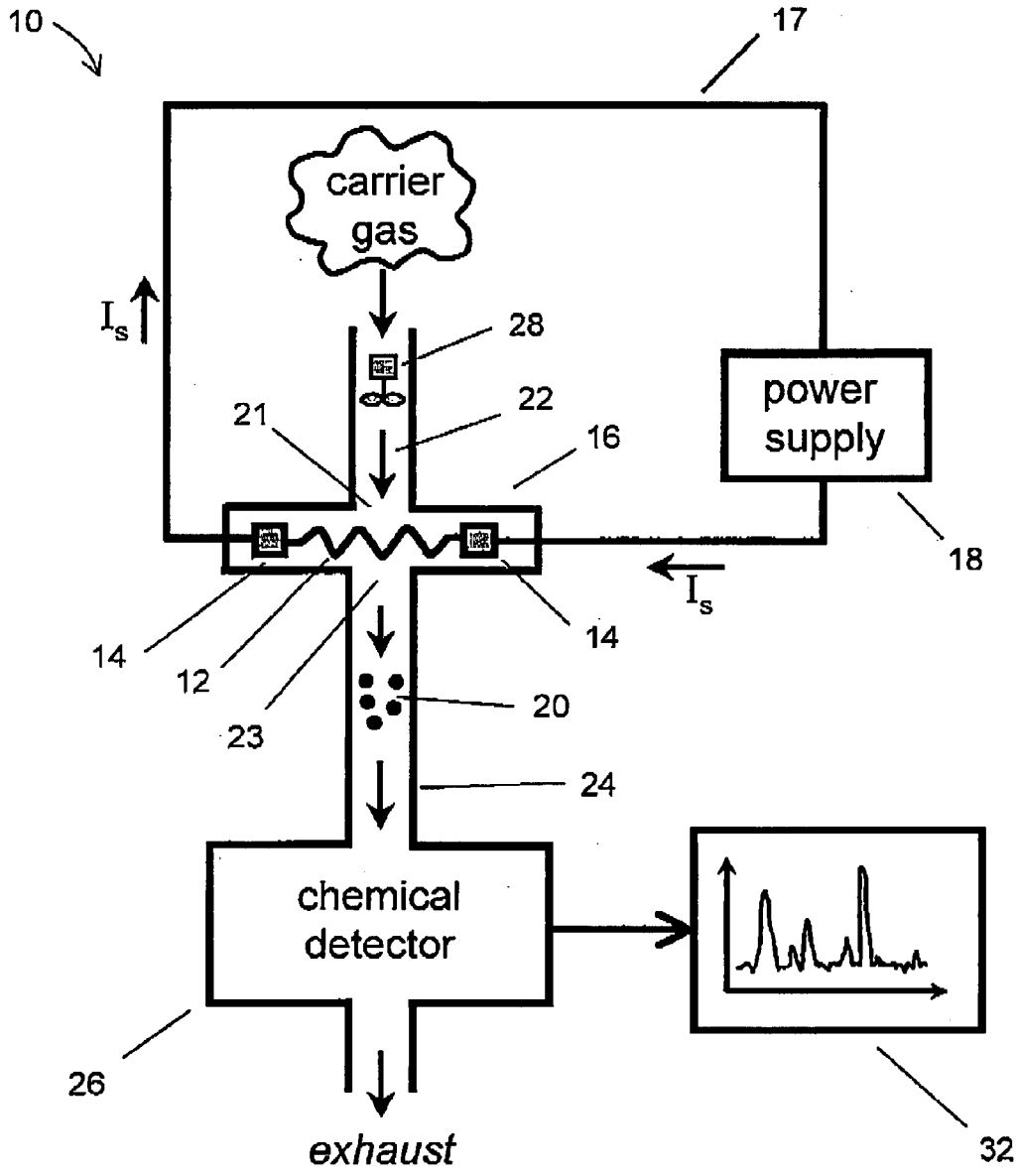
FIG. 1 shows a schematic block diagram of an example of a chemical detection system according to the present invention.

FIG. 1 shows a schematic block diagram of an example of a chemical detection system, according to the present invention. Chemical detection system 10 comprises a porous (i.e., pervious) metallic preconcentrator screen 12 (also referred to as a preconcentrator mesh, substrate, or sample) held in a screen holder 14. Screen holder 14 securely holds screen 12 and makes good electrical contact on opposite edges of screen 12, for driving electrical current, $I_s$, across screen 12 from one edge to the other. Screen holder 14 may comprise a pair of electrically-insulated, opposed panels pivotally connected to each other along one edge by a hinge, with panel latching means for clamping and tightly holding the porous metallic substrate (i.e., screen 12) between the panels, the substrate being electrically insulated from the panels; and a pair of spaced electrical contacts mounted on the panels such that when the substrate is clamped and tightly held by the holder, the contacts touch the substrate and make good electrical contact. A more detailed description of screen holder 14 (also called a substrate holder) can be found in U.S. Pat. Nos. 6,572,825 and 6,978,657, both of which are incorporated herein by reference.

Detection system 10 further comprises a desorption chamber 16 in which the screen holder 14 (holding screen 12) can be inserted and securely held. Desorption chamber 16 can have a pair of electrical contacts (e.g., pins, prongs, etc., not shown) that can engage mating electrical contacts on holder 14. The pair of electrical contacts inside desorption chamber 16 are electrically connected to a power supply 18 that supplies the voltage necessary to drive an electrical current, $I_s$, across the metallic preconcentrator screen 12, in screen-heating circuit 17. The flow of electrical current across screen 12 directly heats the screen by Joule-type electrical resistance heating, according to eq. (1):

$$P_{heat}=(I_s)^2R_s \quad (1)$$

wherein $R_s$ is the screen's electrical resistance. As the screen 12 heats up, contaminants are vaporized and thermally desorb. Desorption chamber 16 comprises an inlet 21 for admitting carrier gas 22, which flows through screen 12 in a direction perpendicular to the wide plane of the screen. Carrier gas 22 can be driven by fan 28, or supplied by a pressurized gas bottle, canister or cylinder (not shown). Carrier gas 22 can comprise clean and dry air, nitrogen, helium, or other suitable non-reacting gas.

Screen 12 can comprise: a metallic filter; a felt or felt-like mat of thin, finely-drawn wires; a woven screen or mesh of metal wires; a porous foamed metal structure; a microporous metallic filter with microholes, etc. Screen 12 can be made of fine-gauge stainless steel wires sintered into a porous, felt-like mat, mesh, or felt. The screen can be bare, without any coating or coatings of an organic or polymeric material. Bare stainless steel does not have any particular affinity for any of the target analyte molecules of interest. This feature allows the adsorbed analytes to be easily desorbed and released from a stainless steel screen. Metals other than stainless steel can be used for screen 12, which have a suitable electrical resistance; including, but not limited to, Ferralloy, Hastalloy, Inconel alloys, Inconel 601, Inconel 625, Inconel 718, etc. A thin gold coating can be disposed on the screen's surfaces to provide oxidation resistance and prevent chemical reactions from occurring between the explosive compounds and, for example, an oxidized (i.e., chromium oxide) surface of a stainless steel wire. Screen 12 can be relatively flexible (i.e., for swiping across curved surfaces), or it can be relatively rigid. It can be pre-formed, for example, with a plurality of folded pleats or corrugations to provide a larger surface area for adsorbing target contaminants.

Alternatively, screen 12 can be coated with an organic or polymeric material that can absorb or adsorb a particular chemical or class of chemicals. Such an organic or polymeric coating may be sufficiently thin so as to not clog-up or fill the empty spaces in-between screen wires, pores, filter spaces, etc. Some examples of suitable organic or polymeric materials for coating the screen include: nano-carbon; carbon nanotubes; a carbon molecular sieve adsorbent resin (e.g., Carboxen 569 manufactured by Supelco, inc., Bellefonte, Pa.); a porous polymer resin based on 2,6-diphenylene-oxide (e.g., Tenax TA manufactured by Supelco, Inc.); cyclo-dextrin and its related compounds, e.g., beta-cyclodextrin, beta-cyclodextrin hydrate, hydroxypropyl-beta-cyclodextrin, hydroxyethyl-beta-cyclodextrin, methyl-beta-cyclodextrin, cycloheptaamylose, and glucose-beta-cyclodextrin; a quaternary ammonium salt; benzalkonium chloride; benzethonium chloride; cetylpyridinium chloride; myristalkonium chloride; benzyl (C12-C16) alkydimethylammonium chloride; cetalkonium chloride; cetyl trimethyl ammonium chloride; dodecyl trimethyl ammonium chloride; stearyl trimethyl ammonium chloride; alkyl dimethyl ammonium salt; cetyl tetra ammonium bromide; cetyl trimethyl ammonium bromide (CTAB); a CTAB sol-gel; cetyl ethyl dimethyl ammonium bromide; tetradecyl trimethyl ammonium bromide; tetrabutyl ammonium bromide; cyanopropyl phenyl methyl silicone, and combinations thereof. The coating may be in the form of a sol-gel.

Referring still to FIG. 1, desorption chamber 16 comprises an-outlet 23 for carrier gas 22 to carry desorbed target contaminants to chemical detector 26, via transport tube 24. The target contaminants (i.e., analytes) carried by carrier gas 22 can comprise particles, vapors, or gas molecules (or all) that have been thermally desorbed or otherwise released from contaminated screen 12 when resistively heated to an elevated temperature by power supply 18. Gas transport tube 24 can be insulated to reduce heat loss, and can be separately heated to between 100 and 250 C to help prevent analyte molecules from sticking to its walls.

Chemical detector 26 may comprise one or more of the following types of detectors: ion mobility spectrometer (IMS), mass spectrometer (MS), surface acoustic wave sensor (SAW), electron capture device (ECD), differential mobility spectrometer (DMS), chemiluminescence detectors (CLD), gas chromatograph (GC), and thermo redox detectors; and may be miniaturized versions of these, including MEMS versions of these. In some embodiments, two different types of detectors may be combined, e.g., the target analytes exhausted from an IMS can travel to a downstream MS, which performs additional detection and analysis. Alternatively, a gas chromatograph (GC) column may be placed before an IMS to slow down the arrival of the analytes and provide some separation between different chemicals. The output 32 of detector 26 may comprise spectra of various parameters measured by the detector; for example, ion mobility spectral plots of Signal Intensity versus Drift Time (ms), as a function of exposure-time (i.e., clock-time) for an IMS. The signal intensity, drift time, and clock time can be displayed as a 3-D plot called a "plasmagram". Alternatively, the output of detector 26 can be used to provide an alarm if a certain explosive or narcotic has been detected at all. Since an IMS detector operates at essentially ambient pressure, it doesn't require a vacuum pump (unlike a mass spectrometer). Not having a vacuum pump allows the detector to be miniaturized into a portable, hand-held platform, such as Sandia's MicroHound™ sensor platform.

Typically, the preconcentrator screen 12 is flash-heated, e.g., to 200 C in 0.2-0.5 seconds, by direct electric resistance heating using a high amperage current (e.g., 60-80 Amps). Such a high current can be generated, for example, by essentially shorting-out a 12-V lead-acid battery across its terminals (i.e., by being directly connected to the screen). Alternatively, the high current can be generated by rapidly discharging a charged capacitor. When the screen is flash-heated, essentially all of the different species of target analytes are thermally desorbed and released at the same time, where they travel down the gas transport tube 24 in a single, concentrated bunch (e.g., packet, batch, grouping) of analyte gas molecules 20.

A direct temperature measurement of the screen's peak temperature, $T_{max}$, may be made, for example, by using an attached thermocouple or IR sensor, and then used to terminate the heating pulse when a desired target temperature has been reached (i.e., by shutting the screen current off). However, if a direct temperature measurement is not made, then some sort of indirect heating control method must be used. In this latter case, the power supply 18 can be automatically controlled to provide a consistent and amount of resistance heat energy deposited (i.e., generated) in the screen from shot-to-shot (i.e., from one heating pulse to another), so that $T_{max}$ is consistent from pulse to pulse. However, if the battery's voltage is lower than in a previous pulse, then the screen heating current, $I_s$, will also be lower. Hence, it will take longer for the screen to reach the same desired $T_{max}$. A power supply 18 that only uses a fixed heating-time period (i.e., pulse length) would not be able to compensate for gradual decreases in battery voltage.

Accordingly, the present invention provides a methodology and circuit designs for an Integrating Preconcentrator Heat Controller (IPHC) that automatically adjusts (e.g., increases) the length of time that current flows through the screen to properly compensate for a change (e.g., a decrease) in the battery's voltage, from one pulse to the next.

In one embodiment, an Integrating Preconcentrator Heat Controller (IPHC) monitors the accumulated amount of energy deposited in the screen from resistance heating until a desired, pre-set, target amount of energy has been reached, at which point the heating circuit is turned off. This can be accomplished in a number of different ways.

One method of controlling the resistive heating of a metallic chemical preconcentrator screen, according to the present invention, can comprise the following steps:

a) initiating a screen-heating pulse at time=0 by causing an electric current, $I_s$ to flow across a preconcentrator screen by applying a voltage drop, $\Delta V_s$, across the screen from one edge of the screen to the opposite edge; wherein the screen has an in-plane electrical resistance $R_s$; and wherein the current is given by eq. (2a):

$$I_s=\Delta V_s/R_s \tag{2a}$$

and wherein the voltage drop, $\Delta V_s$, is given by eq. (2b):

$$\Delta V_s=I_sR_s \tag{2b}$$

b) increasing, during the heating pulse, the temperature of the screen by depositing internal Joule-type electric resistance heat energy directly in the screen;

c) measuring, as a function of time, the voltage drop, $\Delta V_s$, or the electric current $I_s$, or both;

d) calculating, as a function of time, the heating power, $P_s(t)$, according to any of eqs. (3a), (3b), or (3c):

$$P_s(t)=I_s\Delta V_s \tag{3a}$$

$$P_s(t)=(I_s)^2R_s \tag{3b}$$

$$P_s(t)=(\Delta V_s)^2/R_s \tag{3c}$$

e) calculating the accumulated amount of heat energy, $E_s(t)$, deposited in the screen by integrating the heating power, $P_s(t)$, over time from the beginning of the heating pulse (at t=0) up to the present time, t, according to eq. (4):

$$E_s(t)=\int P_s(t)dt \tag{4}$$

f) comparing, as a function of time, the accumulated heat energy, $E_s(t)$, to a pre-set target amount of energy, $E_{target}$; and then either:

g) continuing to heat the screen if $E_s(t)<E_{target}$; or h) terminating the heating pulse if $E_s(t)\geqq E_{target}$, by stopping the flow of electric current, $I_s$, across the screen;

wherein the net temperature rise, $\Delta T_s$, of the screen, from beginning to end of the heating pulse, is proportional to the total amount of resistance heat energy deposited in the screen during the heating pulse.

This method works well for preconcentrator screens made of thin, finely-drawn metal wires because the net temperature rise, $\Delta T_s=T_{max}-T_s(t=0)$, of the screen is proportional to the total amount of accumulated heat energy, $E_{total}$, deposited in the screen from beginning to end of the heating pulse when the heating is essentially bulk, adiabatic heating. The assumption of bulk, adiabatic heating is reasonably accurate when the heating is directly deposited (i.e., generated) in the thin wires by resistance heating; and when the duration of the heating pulse is much less than the time needed to conduct heat from the center of the screen to its edges; and when the heat loss by convection or by thermal radiation during the pulse is negligibly small (which is true for the relatively low peak temperatures e.g., <200 C, generated during the relatively short pulses, e.g., <1 second).

The desired, pre-set target energy, $E_{target}$, can be predetermined by calibrating the IPHC against a known screen temperature measurement, e.g., by thermocouple or IR sensor.

Additionally, a safety timer can be used to automatically stop the heating pulse if a pre-set safety time limit is exceeded, for example, after 1-2 seconds, to help prevent accidental overheating of the preconcentrator screen in unusual conditions.

The voltage difference (i.e., voltage drop) across the screen, $\Delta V_s = V_2 - V_1$, can be determined by directly measuring the individual voltages, $V_1$ and $V_2$, respectively, at each opposing edge of the screen. Alternatively, one edge of the screen can be connected to ground, in which case $V_1=0$ volts, and $\Delta V_s = V_2$ (or visa-versa). Alternatively, or additionally, the screen current, $I_s$, can be directly measured by using a current sensor, such as an induction loop placed around a wire of heating circuit 17. The screen current, $I_s$, can also be determined by measuring the voltage drop across a precision resistor placed in series with the heating circuit 17, and then using Ohm's Law to calculate the current, $I_s$, flowing through the precision resistor. However, placing such a resistor in series with the preconcentrator screen could draw some of the heating power away from the screen.

The instantaneous heating power, $P_s(t)$, can be calculated in a variety of ways, e.g., by directly measuring the screen current, $I_s$, and directly measuring the screen voltage drop, $\Delta V_s$, and multiplying them together according to eq. (3a), $P_s = I_s \Delta V_s$. In this case, it is not necessary to know the screen resistance, $R_s$. Alternatively, or additionally, the instantaneous heating power, $P_s$, can be calculated by directly measuring the screen current, $I_s$, and then using eq. (3b) to calculate $P_s = (I_s)^2 R_s$, assuming that $R_s$ is known. Alternatively, or additionally, the instantaneous heating power, $P_s$, can be calculated by directly measuring the screen voltage drop, $\Delta V_s$, and then using eq. (3c) to calculate $P_s = (\Delta V_s)^2 / R_s$, assuming that $R_s$ is known. The screen resistance, $R_s$, can be measured from time-to-time with a hand-held resistance meter; or it can be calculated in real-time by directly measuring both $I_s$ and $\Delta V_s$ in real-time during a heating pulse and then using eq. (2b) to calculate $R_s = \Delta V_s / I_s$.

Note that eq. (4) can be rewritten as:

$$E_s(t) = \int (I_s)^2 R_s dt \tag{5}$$

Assuming that the screen resistance, $R_s$, does not change appreciably during a single heating pulse (a reasonable assumption), then eq. (5) simplifies to:

$$E_s(t) = R_s \int (I_s)^2 dt \tag{6}$$

Hence, for constant $R_s$, then $E_s(t)$ is proportional to $\int (I_s)^2$ dt, (with a scaling factor, $R_s$). Likewise, it can be shown that $E_s(t)$ is proportional to $\int (\Delta V_s)^2$ dt (but with a different scaling factor, $1/R_s$). Therefore, it is not necessary to know what the actual screen resistance is, because the ratio of $E_s(t)$ divided by $E_{target}$ is nominally independent of the screen resistance. Hence, the comparison step (f) of the method above can be also accomplished by comparing $\int (\Delta V_s)^2$ dt or $\int (I_s)^2$ dt to pre-selected target values.

Figure 2:
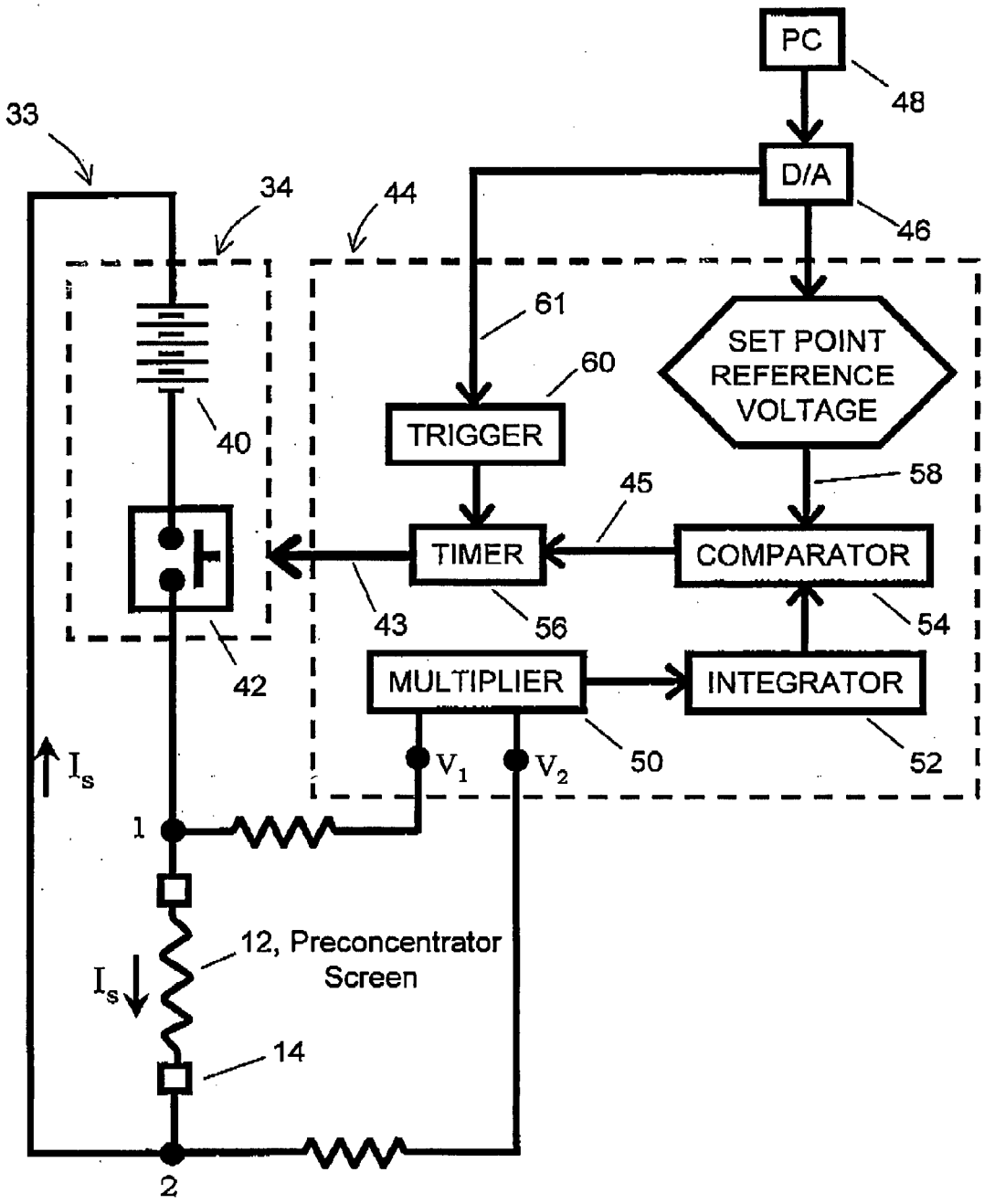
FIG. 2 shows a schematic screen heating circuit comprising a battery-powered power supply controlled by an integrating preconcentrator heat controller (IPHC) that compensates for variations in the voltage of battery by controlling the length of the heating period, according to the present invention.

FIG. 2 shows a schematic example of a screen-heating circuit 33, comprising a battery-powered power supply 34 controlled by an integrating preconcentrator heat controller (IPHC) 44. IPHC 44 compensates for variations in the voltage of battery 40 by adjusting the length of a heating pulse in a controlled manner. At the beginning of a heating pulse, (t=0), timer 56 is started by activating trigger 60. Timer 56 provides a first control signal 43 that causes a high-current capacity screen-heating switch 42 to close, thereby completing screen-heating circuit 37. Screen-heating switch 42 can be, for example, a high-current capacity electromagnetic relay, or a MOSFET power transistor switch. Battery 40 (e.g., a 12-V lead-acid gel-cell) drives a high current, $I_s$, across screen 12, depositing resistive heat energy. Voltage taps, $V_1$, $V_2$, located on opposite sides of screen 12, are connected to voltage inputs in IPHC 44, via isolation resisters (e.g., 470 K) connected in series. The input voltages, $V_1$, $V_2$, are provided to multiplier 50, which calculates the voltage drop, $\Delta V_s = V_1 - V_2$, across the screen, and then squares this value to get $(\Delta V_s)^2 = (V_1 - V_2)^2$. This quantity, $(\Delta V_s)^2$, is then provided to integrator 52, which integrates $(\Delta V_s)^2$ over time to produce a time-dependent output that is proportional to the accumulated amount of resistance heat energy deposited in the screen from t=0 up to the present time, t.

Next, the output of integrator 52 is provided to comparator 54, which continuously compares the output of integrator 52 to a pre-set reference voltage, $V_{ref}$, 58. When the output of integrator 52 exceeds the reference voltage, $V_{ref}$, then comparator 54 sends a reset signal 45 to reset the timer 56; which, in turn, changes the value of the first control signal 43, which causes switch 42 to open and stop the flow of current, $I_s$, thereby terminating the screen heating pulse. A microprocessor or PC 48, connected to a D/A board 46, can be used to generate the reference voltage 58 for comparator 54. Microprocessor 48 and D/A board 46 can also be used to provide a trigger signal 61 to activate trigger 60. Alternatively, instead of using a PC and D/A board, a simple analog variable resistor or potentiometer (shown later in FIG. 3) can be used to provide the pre-set reference voltage 58. Not shown in FIG. 2, for purposes of clarity, are any associated resistors, capacitors, diodes, and power supplies that are typically used in these types of control circuits.

The exact value of reference voltage 58, $V_{ref}$, needed to attain a desired temperature rise for a given type of screen (e.g., pleated or flat), screen holder, battery voltage, etc. can be experimentally calibrated by using a calibrated thermocouple attached to the screen or a calibrated IR camera looking at the screen. A look-up table can be experimentally determined, listing calibrated reference voltages, $V_{ref}$, corresponding to specific peak screen temperatures, $T_{max}$, (or specific increments in screen temperature, $\Delta T_s$). A different look-up table of calibrated reference voltages may be needed for different types of preconcentrator screens (e.g., a flat screen versus a pleated screen, etc.). By using the IPHC methodology and circuit designs of the present invention, these look-up tables should not have to be adjusted as the charge of battery 40 gradually declines. However, if the screen resistance, $R_s$, changes significantly over time, e.g., due to oxidation of the metal screen from overheating, then the look-up table may need to be periodically checked and re-calibrated.

Alternatively, screen-heating switch 42 can be located inside of IPHC 44, rather than inside of power supply 34. A typical 12-V lead-acid gel-cell battery, with a capacity of about 2.3 Amp-Hours lasts about 150 heating pulses, in our portable MicroHound™ IMS trace explosive detector. Initially, with a "fresh" battery 40, the screen-heating pulse length is about 0.3 seconds. However, when using an moderately discharged battery, we have observed that the IPHC 44 automatically extends this pulse length to as long as 0.8-0.9 seconds. Other types of 2.3 Amp-Hour batteries may be capable of heating the screen to the desired temperature, but could take too long to do so.

Figure 3:
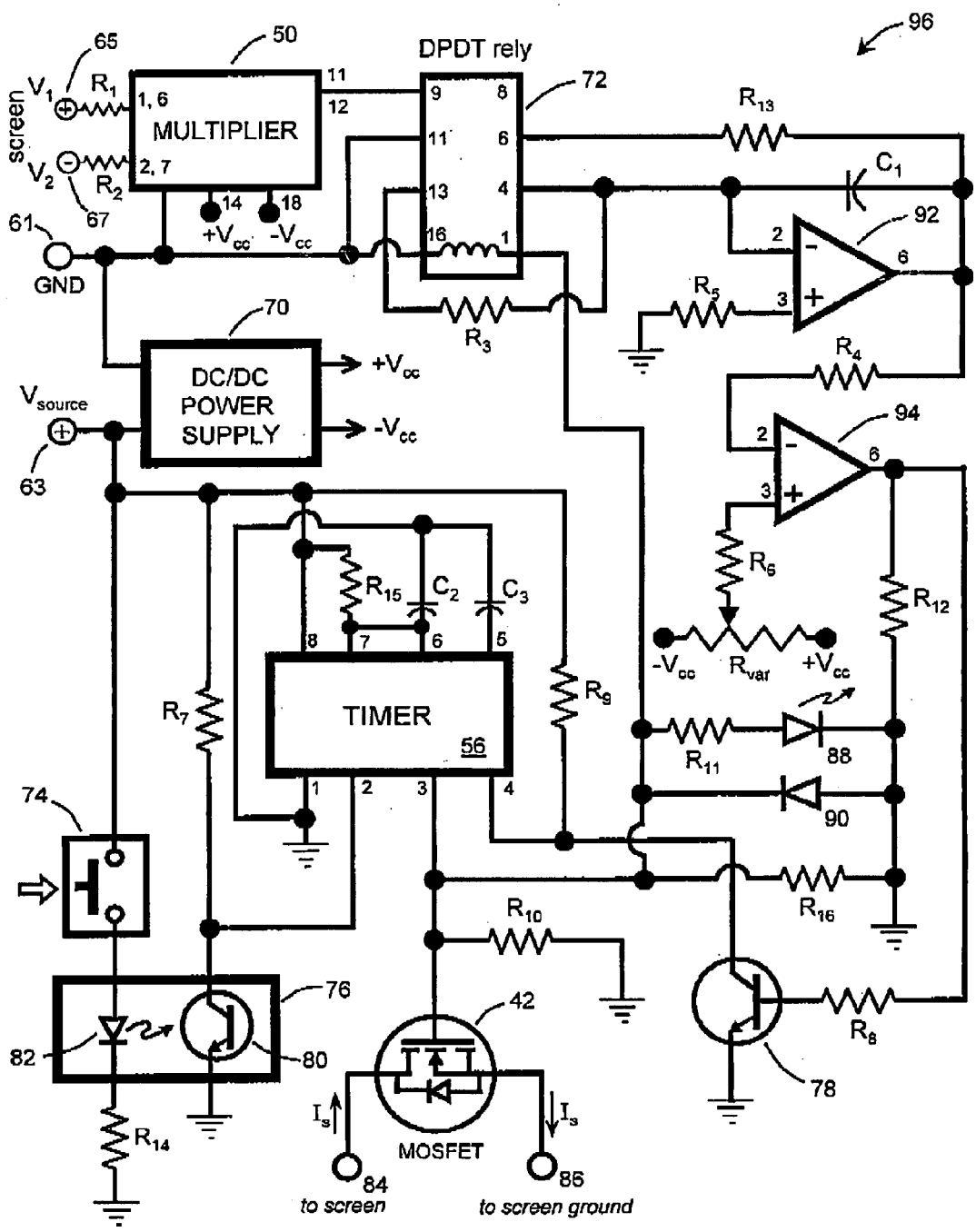
FIG. 3 shows an example of an Integrating Preconcentrator Heat Controller circuit, according to the present invention.

FIG. 3 shows another example of an Integrating Preconcentrator Heat Controller, (IPHC) 96, according to the present invention. IPHC 96 can comprise the following electrical components:

- a ground input, 61;
- a source voltage input, 63, for providing a source of voltage, $+V_{source}$;

a grounded, constant voltage, dual-polarity power supply, 70, powered by source voltage, $+V_{source}$, for generating constant supply voltages $+V_{cc}$ and $-V_{cc}$;

a 16-pin analog multiplier chip 50 powered by supply voltage $+V_{cc}$ at pin 14 and. $-V_{cc}$ at pin 8; and having a ground connection at pin 10;

a pair of screen-voltage inputs, 65 and 67, corresponding to $V_1$ and $V_2$, respectively, connected to input pins (1,6) and pins (2,7), respectively, of multiplier 50; wherein $V_1$ and $V_2$ are measured at opposite edges of a preconcentrator screen (not shown), and wherein the screen voltage drop, $\Delta V_s$ is given by $\Delta V_s = V_1 - V_2$;

a first resistor, $R_1$, connected in series between first screen-voltage input 65 ($V_1$) and input pins (1,6) of multiplier 50;

a second resistor, $R_2$, connected in series between second screen-voltage input 67 ($V_2$) and input pins (2, 7) of multiplier 50;

a 8-pin analog integrating op-amp chip, 92, powered by supply voltage $+V_{cc}$ at pin 7 and $-V_{cc}$ at pin 4 (not illustrated for clarity), wherein the non-inverting (+) input (pin 3) is connected in series via a fifth resistor, $R_5$, to ground;

an integrating capacitor, $C_1$, connected in series across the inverting (−) input (pin 2) of integrating op-amp 92 and the output (pin 6) of integrating op-amp 92;

a 8-pin analog comparator op-amp chip, 94, powered by supply voltage $+V_{cc}$ at pin 7 and $-V_{cc}$ at pin 4 (not illustrated for clarity); wherein the inverting (−) input (pin 2) of comparator op-amp 94 is connected in series via a fourth resister, $R_4$, to the output (pin 6) of integrating op-amp 92;

a 8-pin analog timer chip, 56, powered by $+V_{source}$ at pin 8, and grounded at pin 1; wherein the timer's reset input (pin 4) is connected in series to the voltage source, $+V_{source}$, via a ninth resistor, $R_9$; and wherein the timer's trigger input (pin 2) is connected in series to the voltage source, $+V_{source}$, via a seventh resistor, $R_7$; and wherein pin 5 is connected to pin 1 via a second capacitor, $C_2$; and wherein pin 6 is connected to pin 1 via a third capacitor, $C_3$; and wherein pin 6 is directly connected to pin 7; and wherein pin 7 is connected in series to the voltage source, $+V_{source}$, via a fifteenth resistor, $R_{15}$;

an optically-isolated trigger module, 76, connected to $+V_{source}$ via a push button switch 74; wherein trigger module 76 comprises a trigger LED, 82, and a phototransistor switch, 80, for connecting the timer's trigger input (pin 2) to ground when trigger module 76 is activated by pushing push button switch 74;

a high-current capacity MOSFET power switch, 42, for switching ON/OFF the screen's heating current, $I_s$, flowing through screen-heating current inputs 84 and 86; wherein the base/gate of MOSFET switch 42 is connected to the timer's output (pin 3); and wherein MOSFET switch 42 closes when the timer's output (pin 3) changes from 0 volts to $+V_{source}$ in response to timer 56 being triggered ON by trigger module 76;

a 16-pin DPDT relay, 72, for grounding-out integrating capacitor $C_1$ before the start of a screen heating pulse; and for disconnecting the inverting (−) input (pin 2) of integrating op-amp 92 from the output (pins 11, 12) of multiplier chip 50 before the start of a screen heating pulse; wherein relay 72 comprises an electromagnetic coil connected across pins 1 and 16;

a variable resistor, $R_{var}$, connected to $+V_{cc}$ at its (+) end, and to $-V_{cc}$ at its (−) end;

a sixth resistor, $R_6$, connected in series between the variable resistor's middle-tap and the non-inverting (+) input (pin 3) of the comparator op-amp 94; wherein the reference voltage ($V_{ref}$) present at the non-inverting (+) input (pin 3) of comparator op-amp 94 is determined by the pre-set value of the variable resistor;

a reset transistor switch, 78, connected in series between the timer's reset input (pin 4) and ground; wherein the reset transistor's base/gate is connected in series via an eighth resistor, $R_8$, to the output (pin 6) of comparator op-amp 94; and further wherein the function of reset transistor switch 78 is to ground-out the timer's reset input (pin 4) when the transistor's base/gate voltage changes from $-V_{cc}$ to $+V_{cc}$ in response to a change in the output (pin 6) of comparator op-amp 94 from $-V_{cc}$ to $+V_{cc}$ that occurs when the voltage present at the inverting (−) input (pin 2) of comparator op-amp 94 becomes less than the reference voltage ($V_{ref}$) present at the non-inverting (+) input (pin 3) of comparator op-amp 94;

an indicator LED, 88, connected in series between the output (pin 3) of timer 56 and ground;

a tenth resistor, $R_{10}$, connected in series between the output (pin 3) of timer 56 and ground;

an eleventh resistor, $R_{10}$, connected in series between the output (pin 3) of timer 56 and indicator LED 88;

a twelfth resistor, $R_{12}$, connected in series between the output (pin 6) of comparator op-amp 94 and ground;

a freewheeling diode 90 connected in series between the coil input (pin 1) of DPDT relay 72 and ground; and a fourteenth resistor, $R_{14}$, connected in series from trigger LED 82 to ground;

wherein the output (pin 3) of timer 56 is connected to the coil input (pin 1) of DPDT relay 72;

wherein the coil's output (pin 16) of DPDT relay 72 is connected to ground;

wherein pin 11 of DPDT relay 72 is connected to ground;

wherein pin 13 of DPDT relay 72 is connected in series via a third resister, $R_3$, to pin 4 of DPDT relay 72;

wherein pin 4 of DPDT relay 72 is connected to the inverting (−) input (pin 2) of integrating op-amp 92;

wherein pin 6 of DPDT relay 72 is connected in series via a thirteenth resistor, $R_{13}$, to the output (pin 6) of integrating op-amp 92;

wherein pin 9 of DPDT relay 72 is connected to the output (pins 11,12) of multiplier chip 50; and wherein $R_1 = R_2$.

Figure 4:
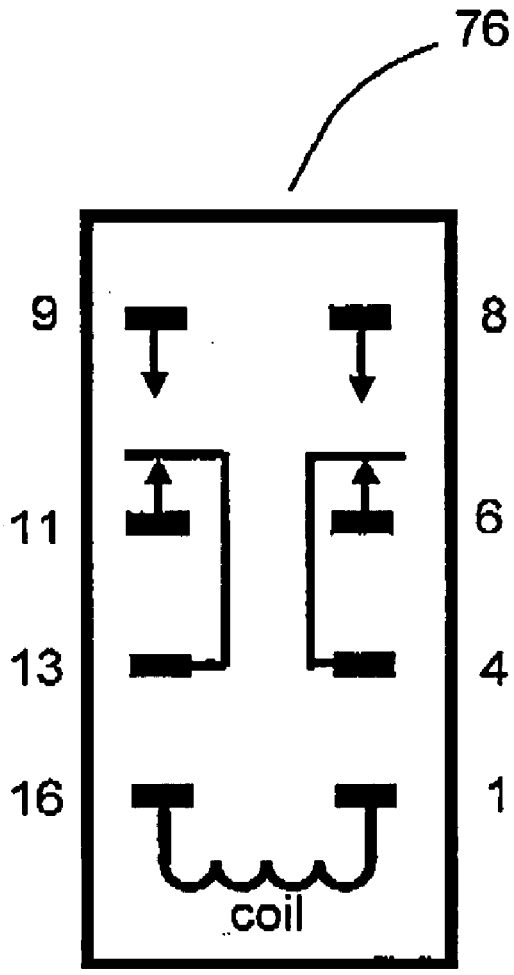
FIG. 4 shows a schematic wiring diagram of the double-pole double-throw (DPDT) relay used in FIG. 3.

FIG. 4 shows a schematic wiring diagram of the double-pole double-throw (DPDT) relay 72 used in FIG. 3.

In one embodiment, $V_{cc}$=15 V and $V_{source}$=12−14 V. Also, Table 1 shows one example of a set of resistor and capacitor values that can be used for the embodiment of an IHPC shown in FIG. 3.

TABLE 1

| Component | Value |
|---|---|
| $R_1$ | 470 KΩ |
| $R_2$ | 470 KΩ |
| $R_3$ | 100 KΩ |
| $R_4$ | 200 KΩ |
| $R_5$ | 100 KΩ |
| $R_6$ | 200 KΩ |
| $R_7$ | 10,000 Ω |
| $R_8$ | 1 MΩ |
| $R_9$ | 22,000 Ω |
| $R_{10}$ | 3900 Ω |

TABLE 1-continued

| Component | Value |
|---|---|
| $R_{11}$ | 1000 Ω |
| $R_{12}$ | 100 KΩ |
| $R_{13}$ | 3900 Ω |
| $R_{14}$ | 10,000 Ω |
| $R_{15}$ | 100 KΩ |
| $R_{16}$ | 100 KΩ |
| $R_{var}$ | 100 KΩ |
| $C_1$ | 0.22 F |
| $C_2$ | 47 μF |
| $C_3$ | 0.01 F |

In an example of the embodiment of the IPHC shown in FIG. 3, the following electronic components may be used:

a) a 24-pin "ASTEC AA05E-012L-15D 12VDC In /+−15VDC Out" module for DC/DC Power Supply 70;

b) a 14-pin "Burr Brown MPY634 Analog Multiplier" for the multiplier chip 50;

c) an 8-pin "National LM 7410p Amp" for integrator op-amp 92;

d) an 8-pin "National LM 7410p Amp" for comparator op-amp 94;

e) a 16-pin "NTE R40-11D2-12 DIP DPDT Relay" for DPDT relay 72; and f) an 8-pin "National LM 555C Timer" for timer 56.

Another embodiment of a method of the present invention can comprise the following steps:

providing the integrating preconcentrator heat controller (IPHC) shown in FIG. 3;

providing the source voltage, $+V_{source}$, to the constant voltage, dual-polarity power supply;

providing the constant supply voltages, $+V_{cc}$ and $-V_{cc}$ to the multiplier chip, the integrating op-amp, and the comparator op-amp;

providing the source voltage, $+V_{source}$, to the trigger module through the push button switch disposed in-between;

providing the source voltage, $+V_{source}$, to the timer's power input;

providing the source voltage, $+V_{source}$, to the timer's trigger input, after passing through the seventh resistor, $R_7$;

providing the source voltage, $+V_{source}$, to the timer's reset input, after passing through the ninth resistor, $R_9$;

starting a screen-heating pulse at time=0 by pushing the push button switch, which activates the trigger module, which temporarily grounds-out the timer's trigger input, which activates the timer and causes the timer's output voltage to equal $+V_{source}$;

activating the indicator LED;

closing the high-current capacity MOSFET power switch, in response to the changing the MOSFET's base voltage to $+V_{source}$; thereby allowing a screen-heating current, $I_s$, to flow across a preconcentrator screen;

energizing the relay coil in the DPDT relay, in response to changing the coil input voltage to $+V_{source}$; which disconnects the integrating capacitor, $C_1$, from ground; and also connects the multiplier chip to the integrating op-amp;

measuring the screen-voltages, $V_1$ and $V_2$, at opposite edges of the preconcentrator screen;

inputting $V_1$ and $V_2$ to the multiplier chip, which determines the difference in voltages, $\Delta V_s = V_2 - V_1$; and then squares this difference to get $(\Delta V_s)^2$;

inputting $(\Delta V_s)^2$ to the integrating op-amp, which integrates $(\Delta V_s)^2$ over time from t=0 to the present time, t, scaled by a constant=$(1/R_{13}C)$; and then outputs a time-dependent voltage, $V_{integ}(t)$ equal to:

$$V_{integ}(t) = -(1/RC)\int(\Delta V_s)^2 dt + V_{initial}$$

wherein $V_{initial}$ equals the initial value of $(\Delta V_s)^2$ at the beginning of a heating pulse (t=0);

inputting $V_{integ}$ (t) to the comparator op-amp, which compares $V_{integ}$ (t) to a pre-set reference voltage, $V_{ref}$; wherein the comparator op-amp outputs $+V_{cc}$ if $V_{integ}(t) > V_{ref}$; or outputs $-V_{cc}$ if $V_{integ}(t) < V_{ref}$;

if the comparator op-amp outputs $-V_{cc}$, then continue the screen-heating pulse; or if the comparator op-amp outputs $+V_{cc}$, then terminate the screen-heating pulse by causing the reset transistor switch to close when the transistor's base voltage changes from $-V_{cc}$ to $+V_{cc}$, which causes the reset input pin of the timer chip to be temporarily grounded through the reset transistor switch, thereby resetting the timer and changing the timer's output voltage back to zero, which causes the MOSFET power switch to open and interrupt the flow of screen-current, $I_s$, across the screen; and which also de-energizes the relay coil of the DPDT relay, thereby disconnecting the multiplier chip from the integrating op-amp, connecting the integrating capacitor, $C_1$, to ground and discharging the capacitor.

In some embodiments, the multiplier op-amp divides $(\Delta V^s)^2$ by a constant, k, so that the output voltage doesn't exceed the op-amp's supply voltage (e.g., +/−15 V). A value of k=10 can be used, which may be the op-amp's default value. Alternatively, the constant, k, can be changed by adding a resistor. Because k is a constant, the circuit functions in exactly the same way since the output of the voltage multiplier is proportional to the square of the input, whether or not the output is divided by the constant, k.

The particular examples discussed above are cited to illustrate particular embodiments of the invention. Other applications and embodiments of the apparatus and method of the present invention will become evident to those skilled in the art. For example, the methods and IPHC devices of the present invention can be easily adapted and used to provide a consecutive series of smaller heating steps, strung together in a single heating pulse, to provide a stepped temperature heating profile; wherein the lengths of each time heating period needed to reach each of the individual stepped temperature.

It is to be understood that the invention is not limited in its application to the details of construction, materials used, and the arrangements of components set forth in the following description or illustrated in the drawings.

The scope of the invention is defined by the claims appended hereto.

What is claimed is:

1. A method of controlling the resistive heating of a metallic chemical preconcentrator screen, comprising:

a) initiating a screen-heating pulse at time=0 by causing an electric current, $I_s$ to flow across a preconcentrator screen by applying a voltage drop, $\Delta V_s$, across the screen from one edge of the screen to the opposite edge; wherein the screen has an in-plane electrical resistance $R_s$; and wherein the current is given by eq. (2a):

$$I_s = \Delta V_s / R_s \quad (2a)$$

and wherein the voltage drop, $\Delta V_s$, is given by eq. (2b):

$$\Delta V_s = I_s R_s \quad (2b)$$

b) increasing, during the heating pulse, the temperature of the screen by depositing internal Joule-type electric resistance heat energy directly in the screen;

c) measuring, as a function of time, the voltage drop, $\Delta V_s$, or the electric current, $I_s$, or both;

d) calculating, as a function of time, the heating power, $P_S$ (t); according to any of the following eqs. (3a), (3b), or (3c):

$$P_s(t)=I_s\Delta V^s \quad (3a)$$

$$P_s(t)=(I_s)^2R_s \quad (3b)$$

$$P_s(t)=(\Delta V_s)^2/R_s \quad (3c)$$

e) calculating the accumulated amount of heat energy, $E_s(t)$, deposited in the screen by integrating the heating power, $P_s(t)$, over time from the beginning of the heating pulse (at t=0) up to the present time, t, according to eq. (4):

$$E_s(t)=\int P_s(t)dt \quad (4)$$

f) comparing, as a function of time, the accumulated heat energy, $E_s(t)$, to a pre-set target amount of energy, $E_{target}$; and then either:

g) continuing to heat the screen if $E_s$ (t)<c $E_{target}$; or h) terminating the heating pulse if $E_s(t)\geqq E_{target}$, by stopping the flow of electric current, $I_s$, across the screen;

wherein the net temperature rise, $\Delta T_s$, of the screen, from beginning to end of the heating pulse, is proportional to the total amount of resistance heat energy deposited in the screen during the heating pulse.

2. The method of claim 1, further comprising:

providing the integrating preconcentrator heat controller (IPHC) of claim 15;

providing the source voltage, $+V_{source}$, to the constant voltage, dual-polarity power supply;

providing the constant supply voltages, $+V_{cc}$ and $-V_{cc}$, to the multiplier chip, the integrating op-amp, and the comparator op-amp;

providing the source voltage, $+V_{source}$, to the trigger module through the push button switch disposed in-between;

providing the source voltage, $+V_{source}$, to the timer's power input;

providing the source voltage, $+V_{source}$, to the timer's trigger input, after passing through the seventh resistor, $R_7$;

providing the source voltage, $+V_{source}$ to the timer's reset input after passing through the ninth resistor, $R_9$;

starting a screen-heating pulse at time=0 by pushing the push button switch, which activates the trigger module, which temporarily grounds-out the timer's trigger input, which activates the timer and causes the timers output voltage to equal $+V_{source}$;

activating the indicator LED;

closing the high-current capacity MOSFET power switch, in response to the changing the MOSFET's base voltage to $+V_{source}$; thereby allowing a screen heating current, $I_s$, to flow across a preconcentrator screen;

energizing the relay coil in the DPDT relay, in response to changing the coil input voltage to $+V_{source}$; which disconnects the integrating capacitor, $C_1$, from ground; and also connects the multiplier chip to the integrating op-amp;

measuring the screen-voltages, $V_1$ and $V_2$, at opposite edges of the preconcentrator screen;

inputting $V_1$ and $V_2$ to the multiplier chip, which determines the difference in voltages, $\Delta V_s=V_2-V_1$; and then squares this difference to get $(\Delta V_s)^2$;

inputting $(\Delta V_s)^2$ to the integrating op-amp, which integrates $(\Delta V_5)^2$ over time from t=0 to the present time, t, scaled by a constant $=(1/R_{13}C)$; and then outputs a time-dependent voltage, $V_{integ}$(t) equal to:

$$V_{integ}(t)=-(1/RC)\int(\Delta V_S)^2dt+V_{initial}$$

wherein $V_{integ}$ equals the initial value of $(\Delta V_s)^2$ at the beginning of a heating pulse (t=0);

inputting $V_{integ}$(t) to the comparator op-amp, which compares $V_{integ}$(t) to a pre-set reference voltage, $V_{ref}$; wherein the comparator op-amp outputs $+V_{cc}$ if $V_{integ}(t)\geqq V_{ref}$; or outputs $-V_{cc}$ if $V_{integ}(t)<V_{ref}$;

if the comparator op-amp outputs $-V_{cc}$ then continue the screen-heating pulse; or if the comparator op-amp outputs $+V_{cc}$, then terminate the screen-heating pulse by causing the reset transistor switch to close when the transistor's base voltage changes from $-V_{cc}$ to $+V_{cc}$, which causes the reset input pin of the timer chip to be temporarily grounded through the reset transistor switch, thereby resetting the timer and changing the timer's output voltage back to zero, which causes the MOSFET power switch to open and interrupt the flow of screen-current, $I_s$, across the screen; and which also de-energizes the relay coil of the DPDT relay, thereby disconnecting the multiplier chip from the integrating op-amp, connecting the integrating capacitor, $C_1$, to ground and discharging the capacitor.

3. The method of claim 1, further comprising using a 12-V lead-acid gel-cell battery to provide the voltage necessary to drive a screen-heating current, $I_s$, across a preconcentrator screen during a heating pulse.

4. The method of claim 3, wherein the battery's voltage decreases over time from being discharged or due to aging.

5. The method of claim 1, further comprising terminating the heating pulse if the heating time exceeds a pre-set maximum safety limit.

6. The method of claim 5, wherein the pre-set safety limit equals about 1 second.

7. The method of claim 1, wherein the metallic preconcentrator screen comprises a sintered mesh of stainless steel wires.

8. The method of claim 1, wherein $R_s$ is equal to about 0.2 ohms.

9. An integrating preconcentrator heat controller (IPHC) for controlling the resistive heating of a metallic chemical preconcentrator screen, comprising:

trigger means for starting a screen-heating pulse at time=0 by causing an electric current, $I_s$ to flow across a preconcentrator screen in response to a voltage drop, $\Delta V_s$, applied across the screen from one edge of the screen to the opposite edge; wherein the screen has an in-plane electrical resistance, $R_s$, and wherein the screen-heating current is given by eq. (2a):

$$I_s=\Delta V_s/R_s \quad (2a)$$

and wherein the voltage drop, $\Delta V_s$, is given by eq. (2b):

$$\Delta V_s=I_sR_s; \quad (2b)$$

means for measuring, as a function of time, the voltage drop, $\Delta V_s$, or the electric current, $I_s$, or both;

power-calculating means for calculating, as a function of time, the heating power, $P_s$ (t); according to any of the following eqs. (3a), (3b), or (3c):

$$P_s(t)=I_s\Delta V_s \quad (3a)$$

$$P_s(t)=(I_s)^2R_s \quad (3b)$$

$$P_s(t)=(\Delta V_s)^2/R_s \quad (3c)$$

integration means for calculating the accumulated amount of heat energy, $E_s(t)$, deposited in the screen by integrating the heating power, $P_s(t)$, over time from the beginning of the heating pulse (at t=0) up to the present time, t, according to eq. (4):

$$E_s(t)=\int P_s(t)dt \quad (4)$$

comparison means for comparing, as a function of time, the accumulated heat energy, $E_s(t)$, to a pre-set target amount of energy, $E_{target}$, and for deciding to continue heating the screen if $E_s(t)<E_{target}$; or to terminate the heating pulse if $E_s(t)\geqq E_{target}$, by stopping the flow of electric current, $I_s$, across the screen;

wherein the net temperature rise, $\Delta T_s$, of the screen from beginning to end of the heating pulse is proportional to the total amount of resistance heat energy deposited in the screen during the heating pulse.

10. The IPHC of claim 9, wherein the measurement means comprises a pair of voltage taps for measuring screen voltages at opposite edges of the metallic preconcentrator screen.

11. The IPHC of claim 9, wherein the power-calculating means comprises analog multiplier means for calculating the screen voltage drop, $\Delta V_s=V_2-V_1$, and for squaring the screen voltage drop, $(\Delta V_2)^2=(V_2-V_1)^2$.

12. The IPHC of claim 9, wherein the integration means comprises analog op-amp means for calculating the integral of $(\Delta V_s)^2$ over time, $V_{integ}(t)=\int(\Delta V_s)^2\,dt$;

wherein the voltage $V_{integ}(t)$ is proportional to the accumulated amount of heat energy deposited in the screen from t=0 up to the present time, t.

13. The IPHC of claim 9, further comprising a timer, and a microprocessor and a D/A board programmed to output a trigger signal for starting the timer at t=0; and for providing a reference voltage signal, $V_{ref}$, for use by the comparator means.

14. The IPHC of claim 9, wherein the comparison means comprises an analog comparator op-amp chip.

15. The IPHC of claim 9, further comprising;

a ground input;

a source voltage input for providing a source of voltage, $+V_{source}$;

a 24-pin grounded, constant-voltage, dual-polarity power supply, powered by source voltage, $+V_{source}$, for generating constant supply voltages $+V_{cc}$ and $-V_{cc}$;

a 14-pin analog multiplier chip powered by supply voltage $+V_{cc}$ at pin 14 and $-V_{cc}$ at pin 8; and having a ground connection at pin 10;

a pair of screen-voltage inputs corresponding to $V_1$ and $V_2$, respectively, connected to input pins (1,6) and pins (2,7), respectively, of the multiplier chip; wherein $V_1$ and $V_2$ are Measured at opposite edges of a preconcentrator screen (not shown), and wherein the screen voltage drop, $\Delta V_s$ is given by $\Delta V_s=V_1-V_2$;

a first resistor, $R_1$, connected in series between the first screen-voltage input ($V_1$) and input pins (1,6) of the multiplier chip;

a second resistor, $R_2$, connected in series between the second screen-voltage input ($V_2$) and input pins (2, 7) of the multiplier chip;

an 8-pin analog integrating op-amp chip powered by supply voltage $+V_{cc}$ at pin 7 and $-V_{cc}$ at pin 4 (not illustrated for clarity), wherein the non-inverting (+) input (pin 3) is connected in series via a fifth resistor, $R_5$, to ground;

an integrating capacitor, $C_1$, connected in series across the inverting (−) input (pin 2) and the output (pin 6) of the integrating op-amp;

an 8-pin analog comparator op-amp chip powered by supply voltage $+V_{cc}$ at pin 7 and $-V_{cc}$ at pin 4 (not illustrated for clarity); wherein the inverting (−) input (pin 2) is connected in series via a fourth resister, $R_4$, to the output (pin 6) of the integrating op-amp;

an 8-pin analog timer chip powered by $+V_{source}$ at pin 8, and grounded at pin 1; wherein the timer's reset input (pin 4) is connected in series to the voltage source, $+V_{source}$, via a ninth resistor, $R_9$; and wherein the timer's trigger input (pin 2) is connected in series to the voltage source, $+V_{source}$, via a seventh resistor, $R_7$; and wherein pin 5 is connected to pin 1 via a second capacitor, $C_2$; and wherein pin 6 is connected to pin 1 via a third capacitor, $C_3$; and wherein pin 6 is directly connected to pin 7; and wherein pin 7 is connected in series to the voltage source, $+V_{source}$, via a fifteenth resistor, $R_{15}$;

an optically-isolated trigger module connected to $+V_{source}$ via a push button switch; wherein the trigger module comprises a trigger LED and a phototransistor switch for connecting the timer's trigger input (pin 2) to ground when the trigger module is activated by pushing the push button switch;

a high-current capacity MOSFET power switch for switching ON/OFF the screen's heating current, $I_s$, flowing through screen-heating current inputs 84 and 86; wherein the base/gate of the MOSFET switch is connected to the timer's output (pin 3); and wherein the MOSFET switch closes when the timer's output (pin 3) changes from 0 volts to $+V_{source}$ in response to the timer being triggered ON by the trigger module;

a 16-pin DPDT relay for grounding-out integrating capacitor $C_1$ before the start of a screen heating pulse; and for disconnecting the inverting (−) input (pin 2) of the integrating op-amp from the output (pins 11, 12) of the multiplier chip before the start of a screen heating pulse; wherein the relay comprises an electromagnetic coil connected across pins 1 and 16;

a variable resistor, $R_{var}$ connected to $+V_{cc}$ at its (+) end, and to $-V_{cc}$ at its (−) end;

a sixth resistor, $R_6$, connected in series between the variable resistor's middle-tap and the non-inverting (+) input (pin 3) of the comparator op-amp; wherein the reference voltage ($V_{ref}$) present at the non-inverting (+) input (pin 3) of the comparator op-amp is determined by the pre-set value of the variable resistor;

a reset transistor switch connected in series between the timer's reset input (pin 4) and ground; wherein the reset transistor's base is connected in series via an eighth resistor, $R_8$, to the output (pin 6) of the comparator op-amp; and further wherein the function of the reset transistor switch is to ground-out the tinier's reset input (pin 4) when the transistors base voltage changes from $-V_{cc}$ to $+V_{cc}$ in response to a change in the output (pin 6) of the comparator op-amp from $-V_{cc}$ to $+V_{cc}$ that occurs when the voltage present at the inverting (−) input (pin 2) of the comparator op-amp becomes less than the reference voltage ($V_{ref}$) present at the non-inverting (+) input (pin 3) of the comparator op-amp;

an indicator LED connected in series between the timer's output (pin 3) and ground;

a tenth resistor, $R_{10}$, connected in series between the timers output (pin 3) and ground;

an eleventh resistor, $R_{11}$, connected in series between the output (pin 3) of the timer and the indicator LED;

a twelfth resistor, $R_{12}$, connected in series between the output (pin 6) of the comparator op-amp and ground;

a freewheeling diode 90 connected in series between the coil input (pin 1) of the DPDT relay and ground; and a fourteenth resistor, $R_{14}$, connected in series from the trigger LED to ground;

wherein the timer's output (pin 3) is connected to the coil input (pin 1) of the DPDT relay;

wherein the coil output (pin 16) of the DPDT relay is connected to ground;

wherein the timer's output (pin 3) is connected to the coil input (pin 1) of the DPDT relay;

wherein the coil output (pin 16) of the DPDT relay is connected to ground;

wherein pin 11 of the DPDT relay is connected to ground;

wherein pin 13 of the DPDT relay is connected in series via a third resister, $R_3$, to pin 4 of the DPDT relay;

wherein pin 4 of the DPDT relay is connected to the inverting (−) input (pin 2) of the integrating op-amp;

wherein pin 6 of the DPDT relay is connected in series via a thirteenth resistor, $R_{13}$, to the output (pin 6) of the integrating op-amp;

wherein pin 9 of the DPDT relay is connected to the output (pins 11, 12) of the multiplier chip; and wherein $R_1=R_2$.

16. The IPHC of claim 15, wherein the resistors and capacitors have the values listed in Table 1.

17. The IPHC of claim 15, wherein $V_{cc}$=15 V, and $V_{source}$=12–14 V.

18. A system for resistively-heating a metallic chemical preconcentrator screen, comprising a screen-heating circuit controlled by the integrating preconcentrator heat controller of claim 9; wherein the screen-heating circuit comprises a metallic chemical preconcentrator screen connected in series with a low-voltage, high-current power source; and a screen-heating switch configured to allow an electric current, $I_s$ to flow across the screen when the switch is closed, thereby increasing the temperature of the screen during a heating pulse by depositing internal Joule-type electric resistance heat energy directly in the screen.

19. The system of claim 18, wherein the comparison means is operatively connected to the screen-heating switch, and causes the switch to open if $E_s(t) \geqq E_{target}$; and to close if $E_s(t) < E_{target}$.

20. The system of claim 18, wherein the screen-heating switch comprises a high-current capacity relay-controlled switch or a high-current capacity MOSFET power switch, capable of handling a high current in the range of 60-80 amps.

21. The system of claim 18, wherein the low-voltage, high-current power source comprises a 12-V high-current capacity lead-acid gel-cell battery.

22. The system of claim 18, wherein the metallic preconcentrator screen comprises a sintered mesh of stainless steel wires, and has an electrical resistance, $R_s$, equal to about 0.2 ohms.

* * * * *